United States Patent [19]

Riegler et al.

[11] 3,995,841

[45] Dec. 7, 1976

[54] CONVERTER DRIVE AND BEARING ARRANGEMENT

[75] Inventors: Ernst Riegler, Enns; Manfred Schmidt; Horst Wimmer, both of Linz, all of Austria

[73] Assignee: Vereinigte Osterreichische und Eisen- Stahlwerke-Alpine Montan Aktiengesellschaft, Linz, Austria

[22] Filed: Nov. 17, 1975

[21] Appl. No.: 632,794

[30] Foreign Application Priority Data

Dec. 9, 1974 Austria ..... 9799/74

[52] U.S. Cl. ..... 266/246; 74/411.5

[51] Int. Cl.[2] ..... C21C 5/50

[58] Field of Search ..... 266/245, 246, 247; 74/409, 411.5

[56] References Cited

UNITED STATES PATENTS

| | | | |
|---|---|---|---|
| 3,207,002 | 9/1965 | Lakin et al. | 266/246 X |
| 3,771,777 | 11/1973 | Fisher et al. | 266/246 |

*Primary Examiner*—Richard B. Lazarus
*Assistant Examiner*—John E. Roethel
*Attorney, Agent, or Firm*—Burns, Doane, Swecker & Mathis

[57] ABSTRACT

An apparatus for preventing the transmission of converter oscillations in the blowing phase onto the converter carrying bearings and the converter drive, wherein at least one of the carrying trunnions of the converter is driven by a spur gear with a plurality of slip-on gears arranged around the periphery of the spur gear wheel and at least one of the drive pinions of the slip-on gears can be braced relative to the spur gear wheel and the torsion flank play is compensated.

14 Claims, 11 Drawing Figures

CONVERTER DRIVE AND BEARING ARRANGEMENT

The invention relates to an apparatus for preventing the transmission of converter oscillations in the blowing phase onto the converter carrying bearings and the converter drive, wherein the converter is secured in a carrying-trunnion-containing carrying ring, the carrying trunnions are mounted in a fixed bearing and an expansion bearing and at least one of the carrying trunnions is driven by a spur gear with a plurality of slip-on gears arranged around the periphery of the spur gear wheel.

In the production of steel, oscillations are created at the converters by the reactions of the oxidizing agent with the liquid iron bath. When the converter is in a vertical blowing position, the drive motors of the slip-on gears are mechanically braked, i.e. preferably by means of double jaw brakes, wherein, however, torsion flank plays are present in the individual toothed wheel steps between the drive motors and the spur gear wheel mounted on the converter carrying trunnion. These torsion flank plays, due to the wide distance between the trunnion axis and the mouth of the crucible, cause nodding movements of up to ±50 mm.

The oscillations during the blowing procedure have a frequency of up to 2 Hz and constitute a great danger for the toothing of the spur gear wheel as well as for the useful life of the bearings of the carrying trunnions. When a toothed wheel breaks, there are stand-stills and a loss of production.

The invention aims at preventing the above described disadvantages and difficulties and has as its object to provide a safety means which compensates the torsion flank plays of the gearing steps, prevents the transmission of uncontrollable oscillations and the early wear of the toothings and the carrying bearings.

According to the invention, in an apparatus of the above defined kind this object is achieved in that during the blowing period at least one drive pinion of a slip-on gear is braceable against the spur gear wheel of the spur gear, wherein the torsion flank play is eliminated.

According to one embodiment of the invention, one of the slip-on gears is connected to an additional motor, in particular a compressed-air motor or a hydraulic motor which can be actuated after the braking of all drive motors and the lifting of the brake of the drive motor allocated to the compressed-air motor.

Herein advantageously an engaging and disengaging clutch can be provided between the additional motor and the intermediate gearing of the slip-on gear belonging thereto. Suitably the clutch is designed as a sliding clutch in order to allow for a precise moment adjustment.

According to another embodiment of the invention wherein for each intermediate gearing motor one double jaw brake is provided, during the blowing period the drive pinion of at least one of the slip-on gears can be braced by the drive motor against the spur gear wheel, wherein either one double jaw brake can be retardedly actuated relative to the other double jaw brakes, or, when the brake of one drive motor is lifted and the other drive motors are braked, the lifted (released) drive motor can be actuated with a part of the nominal moment, or, when all brakes are lifted, the drive motors of the intermediate gearings can be actuated with part of their nominal moments.

A further embodiment of the invention consists in that, when all drive motors have been braked, the axial distance between at least one pinion and the spur gear wheel is variable until the left and right flanks of a pinion tooth are interlocked with the left and right flanks of a spur gear wheel tooth.

Herein advantageously a herringbone-toothed pinion is arranged in eccentric bushings of the spur gear wheel housing, and the eccentric bushings are rotatable for a change in thhe axial distance and for bringing about the locking position.

The pinion or pinions, whose axial distance relative to the spur gear wheel is changeable, can have shortened teeth.

Finally, a further embodiment of the invention consists in that, after braking of all drive motors, at least one of the pinions is axially displaceable until the flanks directed to the left and the flanks directed to the right of the engaging pinion teeth are interlocked with the corresponding tooth flanks of the spur gear wheel.

Advantageously, in all the embodiments of the invention, as a safety measure, it is provided for an electric disconnection of the tilting drive when the pinion or pinions are in the bracing position with the spur gear wheel.

The invention shall now be described in more detail by way of examples and with reference to the accompanying drawings, wherein FIGS. 1, 2 and 3 show a front view, a horizontal plan and a side view of a converter together with bearing means.

FIG. 4 schematically illustrates the compensation of the torsion flank play in an embodiment with the additional motor which is shown in FIG. 2.

Figure 3:
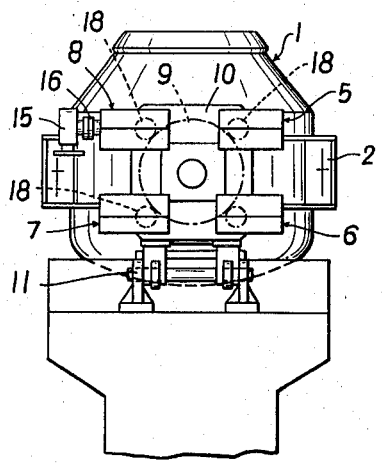
Figure 1:
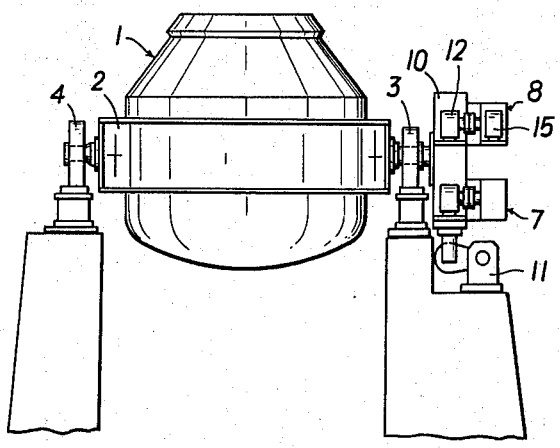
Figure 4:
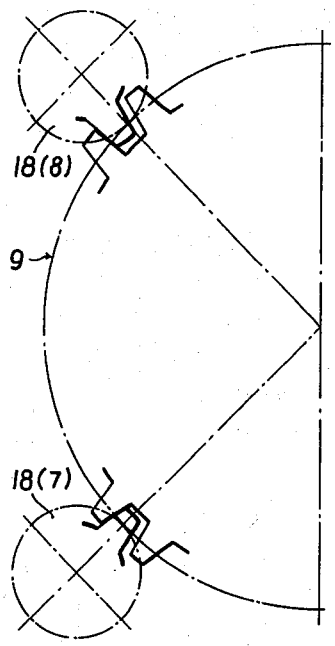
Figure 2:
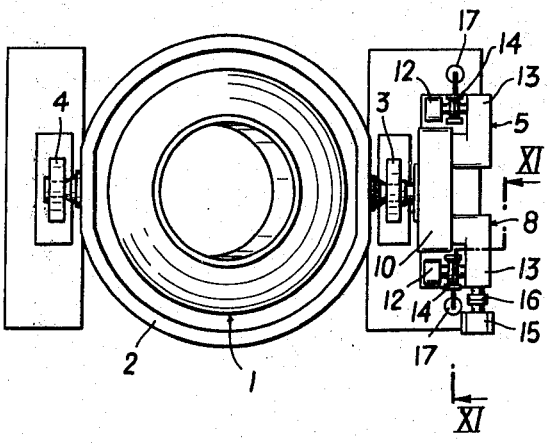
Figure 11:
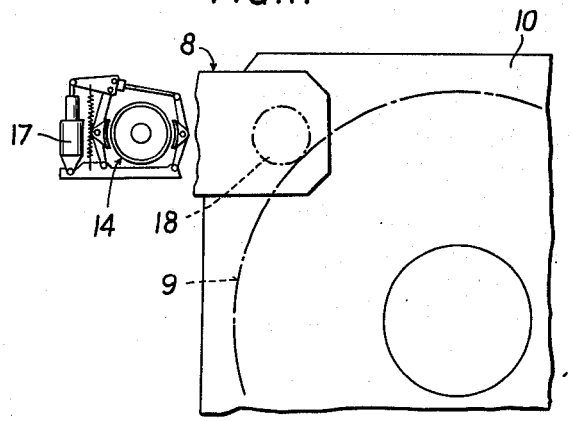
FIG. 11 is a section along line XI/XI of FIG. 2 and illustrates the braking system which can be used in all the embodiments of the invention.

In FIG. 1 a converter plant can be seen whose spur gear wheel is supplied with four slip-on gears. Depending on the size of the converter also a greater number of slip-on gears can be used. The converter denoted with 1 is mounted in the carrying ring 2 which, with its carrying trunnions, is mounted in fixed bearing 3 and in expansion bearing 4. The spur gear wheel 9 mounted on one of the carrying trunnions is enclosed in the gear box 10 which is supported on the base via a torque support 11. The slip-on gears denoted with 5, 6, 7 and 8 are mounted on the gear box 10. From the horizontal plan of FIG. 2 it can be seen that the slip-on gears 5, 8 are provided with one drive motor 12 each and with one double jaw brake 14 each, arranged between the drive motor and the intermediate gearing 13. One of the slip-on gears, i.e. the one denoted with 8, is provided with an additional motor 15, which is arranged to follow the drive motor 12 and which can be driven hydraulically or with air under pressure. This additional motor which is connected with the intermediate gearing via an engaging and disengaging clutch 16, can also be used as an emergency drive motor in case of a disturbance of the other driving means. FIG. 11 which is a section along line XI/XI, shows one of the double jaw brakes in open position. To each brake a brake lifter which can be pneumatically actuated is allocated and denoted with 17. FIG. 4 illustrates the functioning of this embodiment. The converter is in vertical blowing position, the drive motors are braked via the double jaw brakes 14. The double jaw brake which is allocated to the drive motor of the slip-on gear 8 is pneumatically lifted. At the same time the additional motor is put into motion. It rotates until all of the tooth plays in all the intermediate gearings and on the spur gear wheel are overcome. This bracing is independent of the direction of rotation of the additional motor. The spur gear wheel is prevented from spinning by the mechanically braked intermediate gearing. After the bracing of the tooth flanks in the above described manner the double jaw brake allocated to the additional drive motor is braked, and the additional motor is turned off. Thus the condition shown in FIG. 4 is obtained. Oscillations of the blowing converter cannot be transmitted onto the converter bearing means and its drive means. As a safety measure, when the additional motor is operated, the tilting drive of the converter is electrically disconnected.

According to a further embodiment of the invention, a bracing of the toothing flanks (FIG. 4) can also be obtained without an additional motor, with the drive motors alone, in the following three ways:

One of the slip-on gears has a built-in sunk valve known per se in the brake lifter 17 of the double jaw brake allocated to it, which causes a retarded actuation of the brake, which means that when the brakes of the intermediate gearings are actuated, three of the intermediate gearings are braked at once and one intermediate gearing is retardedly braked. When the converter is set upright into the blowing position, the brakes of the intermediate gearings are actuated and the converter is brought to a stand-still by the intermediate engagement of three brakes. The retardedly braked intermediate gearing is somewhat slower. Herein the flywheel effect of the rotating masses of the toothed wheel steps and shafts overcomes the tooth plays, and the spur gear wheel is fixed, as shown in FIG. 4.

According to another possible mode of operation, the converter is brought into the blowing position and braked by the brakes of the intermediate gearings. Then the double jaw brake of an intermediate gearing is opened, and the motor of this intermediate gearing is actuated with a part of its nominal moment. It turns until all tooth plays in the gear steps are overcome. Then the intermediate gearing can be braked and the motor can be turned off during the blowing procedure, or the motor can remain in operation during the blowing procedure. In both cases, as shown in FIG. 4, the spur gear wheel is braced against the drive pinions.

A further possibility of fixing the spur gear wheel according to FIG. 4 is to open all double jaw brakes after the converter has been set upright into the blowing position and the converter has been braked, and to actuate the drive motors of all or of a number of the intermediate gearings, but at least of two intermediate gearings, with a part of their nominal moments against one another, wherein the sum of the moments turning to the left is equal to the sum of the moments turning to the right. After a short time of operation the motors are turned off after actuating the brakes, and the bracing position according to FIG. 4 is achieved.

Figure 5:
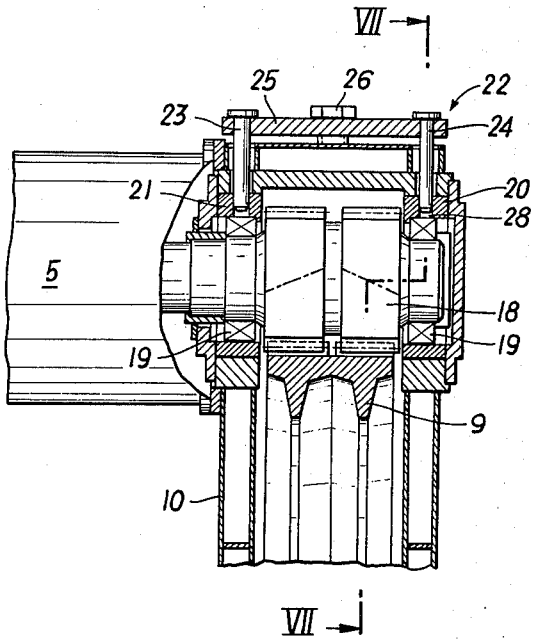
FIG. 5 shows a section of a spur gear wheel axis and a pinion engaging with the spur gear wheel, wherein the axial distance between the pinion and the spur gear wheel is variable, i.e. in a manner as schematically shown in FIG. 8.
Figure 7:
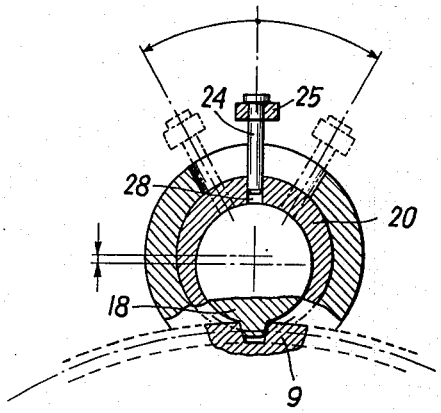
FIG. 7 is a section along line VII/VII of FIG. 5.
Figure 6:
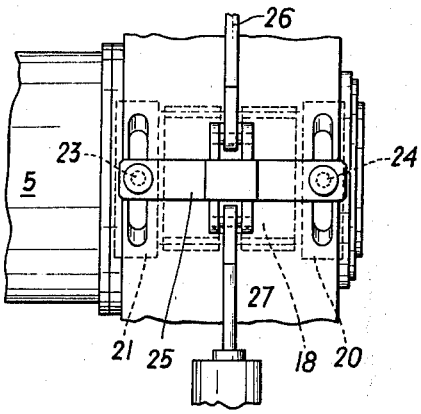
FIG. 6 is a top view in the direction of the arrow of FIG. 5.
Figure 8:
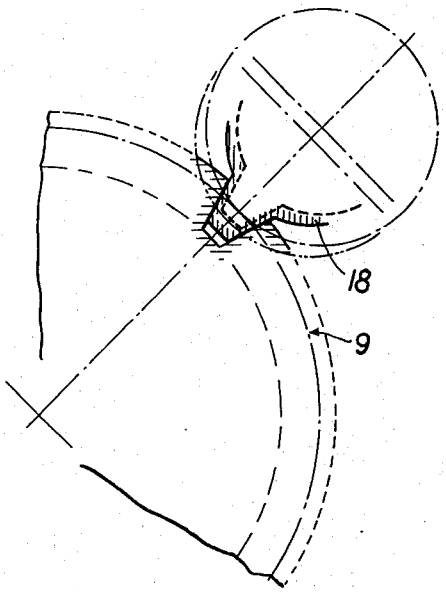

The embodiment illustrated in FIGS. 5, 6 and 7 of an apparatus according to the invention comprises an adjustable pinion 18, two rolling bearings 19, an intermediate gearing 5, two eccentric bushings 20, 21 and an actuation means 22 for adjusting the eccentric bushings. This means consists of bolts 23, 24 which are connected by a rail 25, and two rams 26, 27 which are movable towards the rail 25, hydraulically, e.g.. The bolts 23, 24 engage in bores 28 of the eccentric bushings, so that these are rotatable when the rams are actuated. When the eccentric rings are rotated, the distance between the pinion axis and the spur gear wheel axis is reduced, as can be seen in FIG. 8. Advantageously the adjustable pinion is provided with shortened teeth in order to obtain a secure tooth flank contact in the bracing position. In the blowing position the intermediate gearings are braked, and one of the drive pinions is rotated in direction towards the spur gear wheel until the tooth flanks of the pinion and the spur gear wheel contact with each other. In the embodiment of FIG. 5 a herringbone-toothed pinion is shown, but this embodiment of the invention can also be used for straight-toothed pinions.

Figure 9:
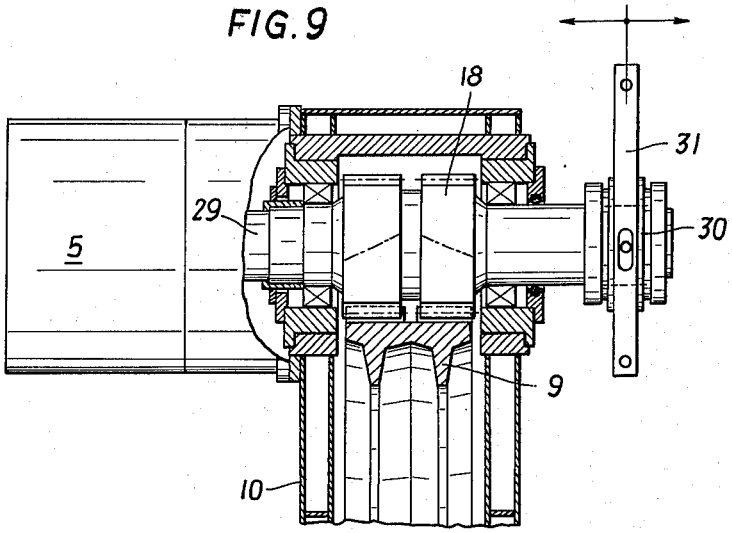
FIG. 9 is another section of the spur gear wheel axis and a pinion engaging with the spur gear wheel in a further embodiment of the invention, and FIG. 10 schematically illustrates the manner in which this device functions.
Figure 10:
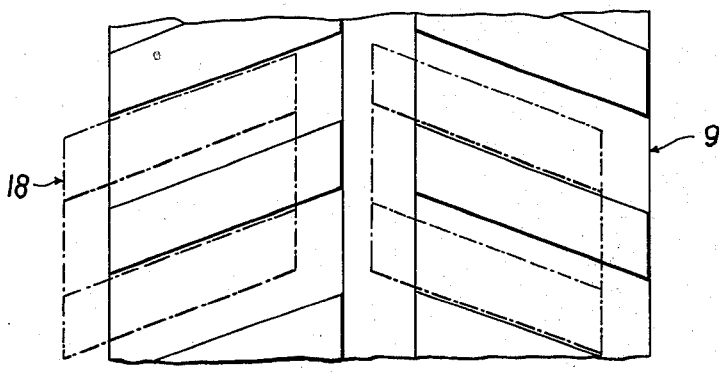

Finally, in FIGS. 9 and 10 another embodiment of the apparatus of the invention with herringbone-toothed pinions is illustrated. Here the floatingly arranged pinion shaft 29 is extended for accommodating a slip ring 30. The slip ring is mounted in a fork 31 which is movable in axial direction by means of air under pressure or hydraulically. After the converter has been set upright into the blowing position, in this embodiment the intermediate gearings are braked, and one of the drive pinions is moved in the direction of its axis until the tooth flanks of the pinion are braced with the corresponding tooth flanks of the spur gear wheel as shown in FIG. 10.

What we claim is:

1. In a converter drive and bearing arrangement with converter carrying bearings and converter drive means for preventing a transmission of converter oscillations onto the converter carrying bearings and the converter drive means while the converter is in blowing phase, which arrangement comprises a converter,
a converter carrying ring,
two converter carrying trunnions arranged on the carrying ring,
a fixed bearing accommodating one of the converter carrying trunnions,
an expansion bearing accommodating the second of the converter carrying trunnions,
a spur gear with a spur gear wheel,
a plurality of slip-on gears having drive pinions and being peripherally arranged on the spur gear wheel of the spur gear, at least one of the converter carrying trunnions being driven by the spur gear, the improvement comprising that during the blowing phase of the converter at least one of the drive pinions of one of the slip-on gears is braced relative to the spur gear wheel of the spur gear and wherein there is no torsion-flank-play.

2. A converter drive and bearing arrangement as set forth in claim 1, further comprising drive motors connected with the slip-on gears,
brakes for braking the drive motors, one additional motor arranged on one of the slip-on gears, which can be actuated when all the other drive motors have been braked and the brake of the drive motor allocated to the one additional motor has been lifted.

3. A converter drive and bearing arrangement as set forth in claim 2, wherein the additional motor is a compressed-air motor.

4. A converter drive and bearing arrangement as set forth in claim 2, wherein the additional motor is a hydraulic motor.

5. A converter drive and bearing arrangement as set forth in claim 2, further comprising an intermediate gearing for the slip-on gears, wherein an engaging and disengaging clutch is arranged between the additional motor and the intermediate gearing belonging to the respective slip-on gear.

6. A converter drive and bearing arrangement as set forth in claim 1, further comprising one intermediate gearing each for the slip-on gears,
a drive motor for each intermediate gearing,
double jaw brakes each allocated to one of the drive motors, wherein during the blowing phase of the converter the drive pinion of at least one of the slip-on gears can be braced against the spur gear wheel by the drive motor.

7. A converter drive and bearing arrangement as set forth in claim 6, wherein the bracing of the at least one slip-on gear and the spur gear wheel is effected by a retarded actuation of one double jaw brake relative to the other double jaw brakes.

8. A converter drive and bearing arrangement as set forth in claim 6, wherein the bracing of the at least one slip-on gear and the spur gear wheel is effected by lifting the brake of one drive motor and braking the other drive motors and actuating the drive motor with the lifted brake with part of its nominal moment.

9. A converter drive and bearing arrangement as set forth in claim 6, wherein the bracing of the at least one slip-on gear and the spur gear wheel is effected by lifting all the brakes and actuating the drive motors of the intermediate gearings with part of their nominal moment against one another.

10. A converter drive and bearing arrangement as set forth in claim 1 with drive motors, wherein after braking of all the drive motors the axial distance between at least one pinion and the spur gear wheel is changeable until the left and right flanks of a pinion tooth are locked with the left and right flanks of a spur gear wheel tooth.

11. A converter drive and bearing arrangement as set forth in claim 10 with a herringbone-toothed pinion, further comprising a housing for the spur gear wheel,
eccentric bushings arranged in the housing for the spur gear wheel and accommodating the herringbone-toothed pinion, which eccentric bushings are rotatable for changing the axial distance and bringing about the locking position.

12. A converter drive and bearing arrangement as set forth in claim 10, wherein the pinions whose axial distance from the spur gear wheel is changeable, have shortened teeth.

13. A converter drive and bearing arrangement as set forth in claim 1 with herringbone-toothed pinions and with drive motors, wherein the pinions have teeth with flanks directed to the left and flanks directed to the right and wherein after braking of all drive motors at least one of the drive pinions is axially displaceable until the flanks directed to the left and the flanks directed to the right of the meshing pinion teeth are locked with the respective tooth flanks of the spur gear wheel.

14. A converter drive and bearing arrangement as set forth in claim 1 with a tilting drive, wherein when at least one drive pinion is braced with the spur gear wheel, the tilting drive is electrically disconnected.

* * * * *

UNITED STATES PATENT OFFICE

CERTIFICATE OF CORRECTION

Patent No. 3,995,841 Dated December 7, 1976

Inventor(s) Ernst Riegler et al

It is certified that error appears in the above-identified patent and that said Letters Patent are hereby corrected as shown below:

Page 1, in the heading after "Assignee": delete "Vereinigte Osterreichische und Eisen- Stahlwerke-" and insert therefor --Vereinigte Österreichische Eisen- und Stahlwerke--

Signed and Sealed this

Twenty-second Day of March 1977

[SEAL]

*Attest:*

RUTH C. MASON
*Attesting Officer*

C. MARSHALL DANN
*Commissioner of Patents and Trademarks*